United States Patent [19]

Suzuki

[11] Patent Number: 4,532,656

[45] Date of Patent: Aug. 6, 1985

[54] POCKET STRUCTURE IN A SOCK OR THE LIKE

[76] Inventor: Tokuo Suzuki, No. 91, Norborito Shin-machi, Tama-ku, Kawasaki-shi, Kanag, Japan

[21] Appl. No.: 512,599

[22] Filed: Jul. 11, 1983

[51] Int. Cl.[3] ..... A41D 27/20

[52] U.S. Cl. ..... 2/247

[58] Field of Search ..... 2/239, 247, 250, 251

[56] References Cited

U.S. PATENT DOCUMENTS

| | | | |
|---|---|---|---|
| 767,381 | 8/1904 | Brown | 2/239 |
| 1,025,643 | 5/1912 | Presmont | 2/239 |
| 3,396,264 | 8/1968 | Murphy et al. | 2/239 X |
| 3,537,108 | 11/1970 | Daniels | 2/247 X |
| 3,611,444 | 10/1971 | Rector | 2/247 |
| 3,670,340 | 6/1972 | Walker | 2/247 X |
| 4,038,699 | 8/1977 | Burn | 2/239 |
| 4,218,781 | 8/1980 | Lieberman | 2/247 |

FOREIGN PATENT DOCUMENTS

| | | | |
|---|---|---|---|
| 2363292 | 5/1978 | France | 2/239 |

*Primary Examiner*—Robert P. Swiatek
*Attorney, Agent, or Firm*—Elliot M. Olstein

[57] ABSTRACT

The invention provides a pocket structure in a sock or the like, wherein personal belongings such as a small purse, a commutation ticket, a key holder, a small pocketbook, a lighter, a pack of cigarettes or the like can be put in the pocket structure.

2 Claims, 7 Drawing Figures

POCKET STRUCTURE IN A SOCK OR THE LIKE

BACKGROUND OF THE INVENTION

This invention relates to a pocket structure formed on a side portion of a sock or the like.

Today, the pocket in clothes becomes more and more ornamental, but its practical value is of course still high particularly for men who have no custom to carry a handbag for personal belongings when going out. Normally, a suit in which an adult man is dressed has a number of pockets. Those pockets are not always enough for putting the personal belongings therein, but perform a necessary function.

However, in the summer season when a shirt or a polo shirt is very popular in lieu of a jacket, a coat or the like, and when wearing clothes having a very few pockets, people feel inconvenient that the number of pockets is few.

Particularly, at the leisure time the casual fashion is now prevailing for both the old and young generation and people are fond of apparel closely fitted to the body. For example, in case of a pocket in slacks, it is so close to the body that it does not perform a substantially practical function. To overcome such inconveniences, it was once proposed to produce a special handbag for men. However, it has no sense in view of men's fashion. This invention has been achieved in order to remove the aforementioned disadvantages.

BRIEF SUMMARY OF THE INVENTION

It is a general object of this invention to provide a pocket structure in a sock or the like, wherein personal belongings such as a small purse, a commutation ticket, a key holder, a small pocketbook, a lighter, a pack of cigarettes or the like can be put in the above novel pocket structure.

Other and further objects, features and advantages of this invention will appear more fully from the following description taken in connection with the accompanying drawings.

BRIEF DESCRIPTION OF THE ACCOMPANYING DRAWINGS

FIG. 2(*b*) is a front view of the pocket structure of FIG. 2(*a*) on a side of the sock 1;

FIG. 3(*b*) is a rear view of the pocket structure of FIG. 3(*a*);

Figure 4A:
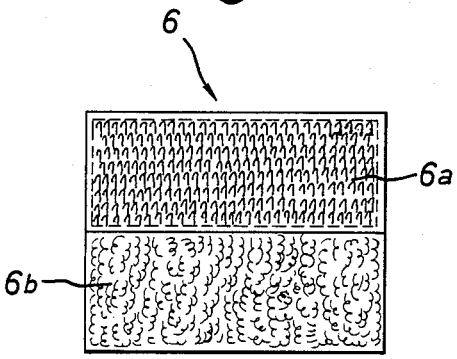
Figure 4B:
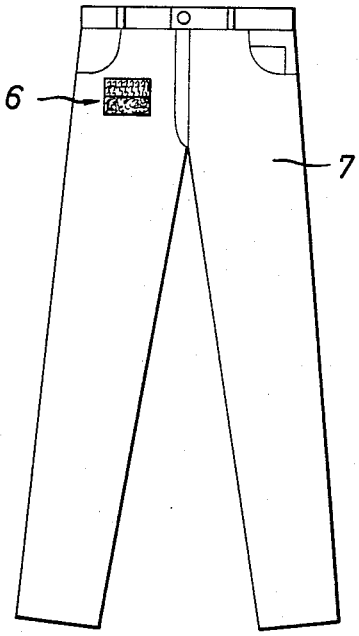

FIG. 4(*a*) and FIG. 4(*b*) are views of utilization of the pocket structure according to this invention.

PREFERRED EXAMPLES OF THE INVENTION

Preferred examples of this invention will now be described with reference to the accompanying drawings.

Figure 1:
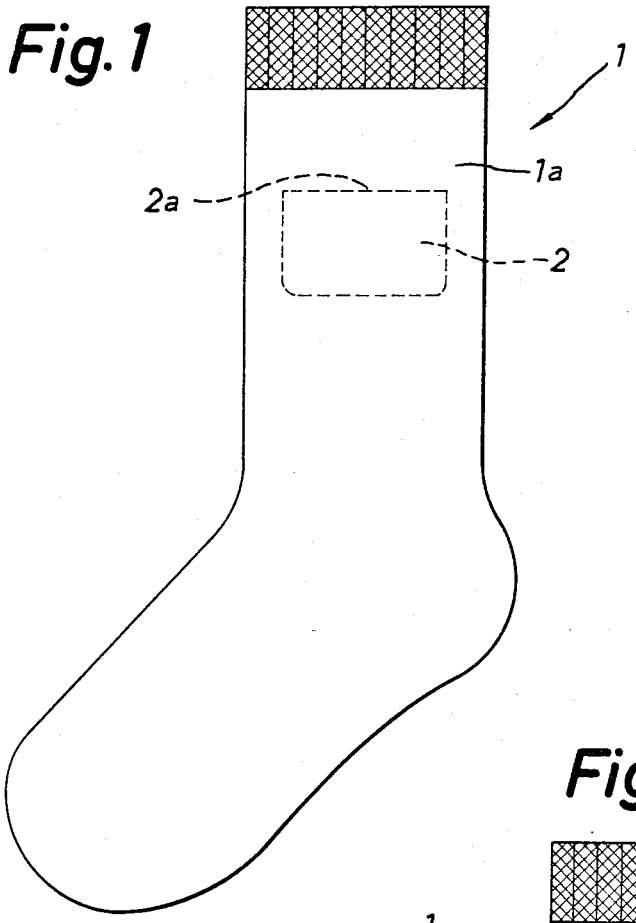
FIG. 1 is a front view of an example of a pocket structure in a sock or the like according to this invention.

In FIG. 1 there is shown a sock 1, and a pocket 2 is attached to an inner portion of a side 1*a* of the sock 1. The pocket 2 is knitted integrally on the inner portion thereof. An opening 2*a* of the pocket 2 may be closed by a slide fastener or the like.

Figure 2B:
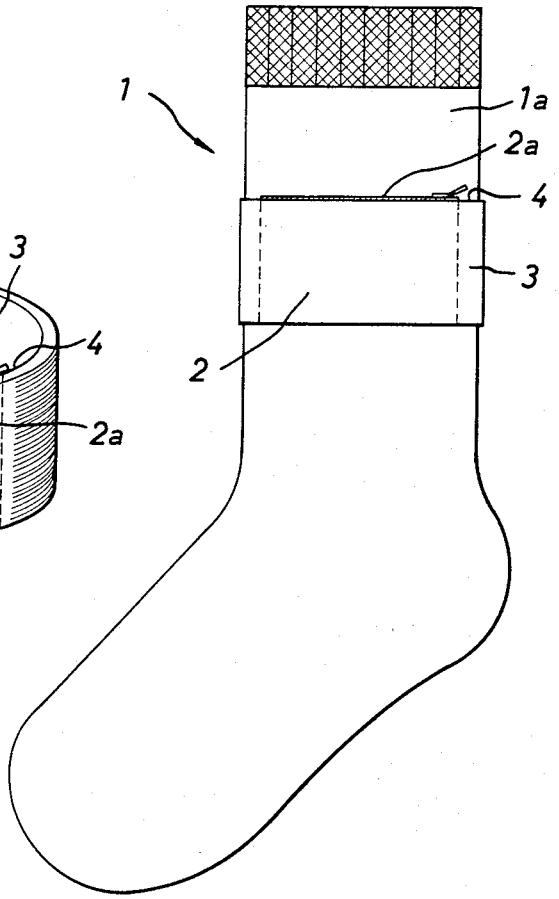
FIG. 2(*a*) is a perspective view of another example of this invention.
Figure 2A:
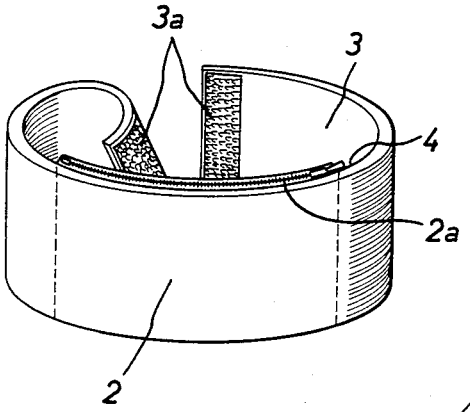

In FIG. 2(*a*) the pocket 2 is attached to an inner portion of a band 3 surrounding the side 1*a* of the sock 1. Both ends of the band 3 may be closed by binding means 3*a* called Magic Tape. The opening 2*a* of the pocket 2 can be closed by the slide fastener 4.

Figure 3A:
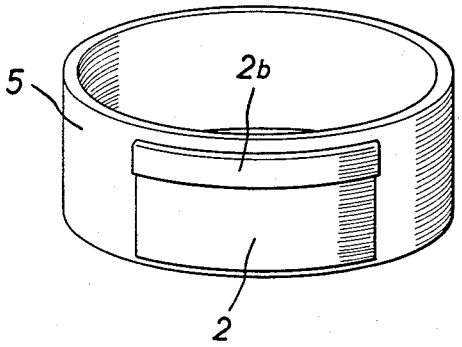
FIG. 3(*a*) is a perspective view of another example of this invention.
Figure 3B:
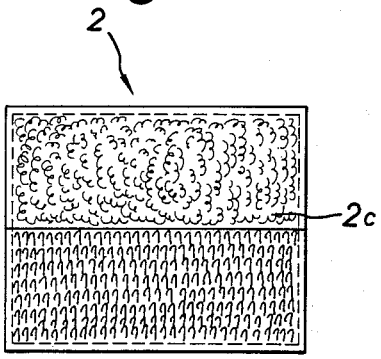

FIG. 3(*a*) shows another example of this invention, in which the pocket 2 is attached on an outer portion of a flexible band 5 surrounding the side 1*a* of the sock 1. The opening 2*a* of the pocket 2 is provided with a flap 2*b*. A rear side 2*c* of the pocket 2 is provided with the Magic Tape as shown in FIG. 3*b* and attached firmly to the outer portion of the flexible band 5.

FIGS. 4(*a*) and 4(*b*) show examples of utilization of the pocket structure of this invention.

Numeral 6 is a cloth strip comprising an upper binding means 6*a* and a lower binding means 6*b* on a surface thereof. The two binding means 6*a* and 6*b* are a so-called Magic Tape. Referring to the use of the cloth strip 6, only its upper binding means 6*a* is attached to a front side of slacks 7, but the lower binding means 6*b* is free. Subsequently, the pocket 2 having the rear portion 2*c* made of the Magic Tape (as shown in FIG. 3*b*) is attached on the two binding means 6*a* and 6*b*, whereby a pocket structure is formed. In this way, such cloth strip 6 may be attached to various clothes such as e.g. golf pants, golf skirt, etc.

When the cloth strip 6 is not used, the lower free binding means 6*b* may be attached to the upper binding means 6*a* by turning its inside out. Thus, it is avoided to expose the outer appearance of the Magic Tape 6*a*, 6*b* of the cloth strip 6.

According to one aspect of this invention, when the pocket structure according to this invention is used for e.g. jeans, sport wear, it performs a very remarkable utility.

What is claimed is:

1. A pocket structure for a garment, comprising:

a strip, said strip having first and second portions, said first portion having a rear surface for attachment to a garment and a front surface, said second portion having a rear surface and a front surface, said front surface of the first portion including a first binding means, said front surface of the second portion including a second binding means, said first and second binding means being releasably bindable to each other upon folding the front surface of the second portion over the front surface of the (second) first portion; a pocket, said pocket including a rear portion having a first area and a second area, said first area including a third binding means for releasably binding the first area to the first binding means of the strip, said second area including a fourth binding means for releasably binding the second area to the second binding means of the strip, whereby the pocket is releasably bound to a strip on (a) the garment, and upon removal of the pocket, the front surface of the second portion of the strip may be folded over the front surface of the first portion of the strip and releasably bound thereto.

2. The pocket structure of claim 1 wherein the first, second, third, and fourth binding means are binding tape.

* * * * *